US010873803B2

(12) United States Patent
Strunk

(10) Patent No.: US 10,873,803 B2
(45) Date of Patent: Dec. 22, 2020

(54) AUDIO LOUDSPEAKER AND RELATED METHOD

(71) Applicant: Endow Audio, LLC, Georgetown, KY (US)

(72) Inventor: David T. Strunk, Georgetown, KY (US)

(73) Assignee: ENDOW AUDIO, LLC, Georgetown, KY (US)

( * ) Notice: Subject to any disclaimer, the term of this patent is extended or adjusted under 35 U.S.C. 154(b) by 0 days.

(21) Appl. No.: 16/529,845

(22) Filed: Aug. 2, 2019

(65) Prior Publication Data

US 2020/0092637 A1 Mar. 19, 2020

Related U.S. Application Data

(60) Provisional application No. 62/730,582, filed on Sep. 13, 2018.

(51) Int. Cl.

| | |
|---|---|
| ***H04R 1/26*** | (2006.01) |
| ***H04R 1/28*** | (2006.01) |
| ***H04R 1/02*** | (2006.01) |
| ***H04R 7/20*** | (2006.01) |

(Continued)

(52) U.S. Cl.

CPC ..... *H04R 1/2834* (2013.01); *H04R 1/025* (2013.01); *H04R 1/26* (2013.01); *H04R 1/2819* (2013.01); *H04R 1/2826* (2013.01); *H04R 1/403* (2013.01); *H04R 7/20* (2013.01); *H04R 9/046* (2013.01); *H04R 2201/403* (2013.01)

(58) Field of Classification Search

CPC .... H04R 1/025; H04R 1/2819; H04R 1/2826; H04R 1/2834; H04R 1/26; H04R 1/403; H04R 2201/403; H04R 1/24; H04R 5/02

USPC ..... 381/335, 345, 349, 350, 351, 182, 186, 381/386, 89, 387; 181/144, 145, 147, 181/199

See application file for complete search history.

(56) References Cited

U.S. PATENT DOCUMENTS 3,927,261 A * 12/1975 Dahlquist ..... H04R 1/26 381/335
4,224,469 A * 9/1980 Karson ..... H04R 1/26 181/144

(Continued)

FOREIGN PATENT DOCUMENTS

WO 2017124068 A1 7/2017

*Primary Examiner* — Huyen D Le

(74) *Attorney, Agent, or Firm* — Michael S. Hargis; King & Schickli, PLLC

(57) ABSTRACT

An audio speaker includes an enclosure having a coupling chamber and a loading chamber, at least m radiating drivers, and at least one and no more than m−1 loading driver(s), wherein m is at least two. The coupling chamber acts to couple the at least m radiating drivers and the at least m−1 loading driver(s), for example, and the loading chamber acts to load the loading driver(s). The at least one and no more than m−1 loading driver(s) may have a higher sensitivity than the at least m radiating drivers and the at least m radiating drivers may be arranged within the enclosure to minimize a volume of the coupling chamber. In other embodiments, the at least one and no more than m−1 loading driver(s) may be other types of inducers (e.g., an undriven loading driver(s), a drone cone, a port, or combinations thereof).

28 Claims, 7 Drawing Sheets

(51) Int. Cl.
*H04R 9/04* (2006.01)
*H04R 1/40* (2006.01)

(56) References Cited

U.S. PATENT DOCUMENTS

| | | | | |
|---|---|---|---|---|
| 5,147,986 | A * | 9/1992 | Cockrum | H04R 1/2842 181/145 |
| 6,886,658 | B1 | 5/2005 | Rolph | |
| 7,046,816 | B2 * | 5/2006 | Vandersteen | H04R 1/26 381/182 |
| 2002/0051552 | A1 * | 5/2002 | Schott | H04R 1/2842 381/345 |
| 2005/0111673 | A1 * | 5/2005 | Rosen | H04R 1/227 381/89 |
| 2006/0078144 | A1 | 4/2006 | Stiles et al. | |

* cited by examiner

AUDIO LOUDSPEAKER AND RELATED METHOD

This is a utility application of U.S. Provisional Patent Application Ser. No. 62/730,582 filed on Sep. 13, 2018.

TECHNICAL FIELD

This document relates generally to the audio loudspeaker arts, and more specifically to a loaded audio loudspeaker.

BACKGROUND

This invention relates to audio loudspeakers, and in particular to reducing the size of the loudspeaker without sacrificing sound pressure level (SPL) or clarity in order to improve mobility and placement flexibility. Mobility is important for applications like a disc jockey who moves equipment from one venue to the next. A smaller loudspeaker with equivalent performance to its larger competitor would offer a significant advantage as it would be easier to transport and setup. Similarly, placement of loudspeakers is an important consideration for permanent installations and smaller loudspeakers would allow more flexibility. For instance, smaller loudspeakers would allow more flexibility of arrangement of equipment and performers on a crowded stage. Further, while it is a necessity that the loudspeakers be adequately heard, their presence is often a visual distraction for both mobile and installed applications. Hence, a smaller loudspeaker with equivalent performance is very desirable.

A key element of audio loudspeakers is the transducer, commonly called a driver, which is a device whose movement causes changes in sound pressure that reproduce the desired music or sound. As is known in the art, a typical driver has a voice coil and magnet, which act together when an electrical signal is applied to make a cone, or diaphragm, move back and forth causing sound pressure waves. Each of these components is typically supported by a basket. The driver has two faces. The front or radiating face is open to the listening space and serves the purpose of radiating sound waves to the listener's ear. The back or non-radiating face is typically enclosed by an air space chamber in order to obtain a desired frequency response. The common phrase used to describe the function of the air space chamber is that it loads the driver. In other words, the air space chamber is a loading chamber.

The loading chamber can be either sealed or ported, horn/scoop loaded, or loaded in a transmission line. When sealed, the non-radiating face does not directly contribute to the sound waves heard by the listener. When ported, air mass in the port or mass in a drone cone resonates with the driver at a specific frequency. When loaded in a transmission line or horn, low frequency sound waves are typically allowed to escape the loading chamber into the listening space through an opening in the loading chamber. Together, the driver and its loading chamber are called a loudspeaker.

The overall size of audio loudspeakers is primarily determined by the size of the selected driver, or drivers, and the air space needed to load the driver(s). Driver size increases with increasing specified SPL and with decreasing specified frequency; therefore, a driver to reproduce bass tones for an auditorium is quite large compared to a high frequency driver intended for a small room. Generally, the loading chamber size increases with the driver diameter. The loading chamber volume in such loudspeakers, Vb, is determined by the following characteristics/parameters of the driver and the desired speaker response near its resonant frequency:

Driver Surface Area (Sd)—loading chamber increases with square of Sd;

Driver Free-Air Resonance Frequency (Fs)—loading chamber decreases with square of Fs;

Driver Air Mass Compliance (Mms)—loading chamber decreases with Mms;

Driver Free-Air Resonance Amplitude Coefficient (Qts)—loading chamber increases with Qts; and Desired Speaker Resonance Amplitude Coefficient (Qtc)—loading chamber decreases with Qtc.

The equations that relate the above parameters to the loading chamber size, Vb, are:

$$Vb=Vas/((Qtc/Qts)^2-1); \quad (1) \text{ and}$$

$$Vas=k*Sd^2/(Mms*Fs^2). \quad (2)$$

Since the driver surface area Sd is a function of the square of the driver radius, it can be readily appreciated from examining the above equations that the loading chamber volume, Vb, is dominated by driver diameter since Vb is related to the $4^{th}$ power of driver radius; therefore, the primary means to reduce the overall loudspeaker size for a given driver, or drivers, is to reduce the loading chamber volume.

As shown in FIG. 1, when an array of drivers is deployed in a conventional audio loudspeaker 10, the total loading chamber volume is the sum of the volume needed for each individual driver 12. This is true whether each driver 12 has its own individual loading chamber 14, as shown in FIG. 1, or the drivers 12 share a common loading chamber 16 as shown in FIG. 2.

When an array of radiating drivers is being discussed, it is important to understand whether the drivers are operating in common acoustic phase or in opposing acoustic phase. Acoustic phase is in reference to the polarity of the sound pressure wave radiating into a listening space where the sound is received by a listener and is a combination of both mechanical and electrical phase of the drivers. The possible combinations of mechanical and electrical phase and the resulting acoustic phase are shown in Table 1 below for an array of at least two drivers which share a common air space.

TABLE 1

| Configuration | Mechanical Phase | Electrical Phase | Acoustic Phase |
|---|---|---|---|
| 1 | Drivers face same way | Drivers wired same polarity | Common |
| 2 | Drivers face same way | Drivers wired opposite polarity | Opposing |
| 3 | Drivers face opposite | Drivers wired same polarity | Opposing |
| 4 | Drivers face opposite | Drivers wired opposite polarity | Common |

The most widely used configuration is Configuration 1 of Table 1 wherein the drivers in an array face the same way, are wired in the same polarity, and both drivers radiate. An isobaric design in which one driver radiates and another driver loads can use either Configuration 1 or 4.

For illustration in determining Vb for a given array of drivers, consider the loading chamber volume for an array of four 10" drivers in which each driver has the parameter values shown in Table 2 and a desired loudspeaker Qtc is 0.65.

TABLE 2

| Driver Array Specification | Sd Area of Cone | Fs Resonant Frequency | Qts Resonant Peak |
|---|---|---|---|
| (4) " Radiating | 358 cm | 37.7 Hz | 0.26 |

The loading chamber volume for the array shown in FIG. 2 is determined by inserting the parameters from Table 2 along with a desired Qtc of the loudspeaker into equations (1) and (2) above:

$$Vas=k*Sd^2/(Mms*Fs^2)=36*358^2/(53*37.70^2)=61.2 \text{ liters} \quad (2)$$

$$Vb=Vas/((Qtc/Qts)^2-1)=61.2/((0.65/0.26)^2-1)=10.2 \text{ liters} \quad (1)$$

As shown, a loading chamber of 10.2 liters is required per radiating driver 12; therefore, the configuration in FIG. 1 would have four loading chambers 14 of 10.2 liters each, for a sum or total of 40.8 liters.

Similarly, a combined loading chamber for all four drivers 12, as shown in FIG. 2, can be calculated using 4*Sd and 4*Mms in equation (2). This follows the conventional methodology of summing a driver's surface area and air mass compliance, but not the resonant frequency nor the resonant peak.

$$Vas=k*(4*Sd^2)/((4*Mms)*Fs^2)=36*((4*358)^2)/(4*53)*37.7^2)=244.8 \text{ liters} \quad (2)$$

$$Vb=Vas/((Qtc/Qts)^2-1)=244.8/((0.651.26)^2-1)=40.8 \text{ liters} \quad (1)$$

As determined, the configurations of driver arrays in FIGS. 1 and 2 have the same loading chamber size of 40.8 liters. Since the configuration in FIG. 2 has less complexity due to a lack of internal walls, this configuration is chosen more often than the configuration in FIG. 1.

One long understood but sparingly used approach to lowering loading chamber volume is referred to as isobaric. In an isobaric speaker 18, as noted above and generally shown in FIG. 3 for a single radiating driver, one driver 20 radiates and another driver 22 loads. Such isobaric speakers have been around since the 1950s and are most often used to improve low-end frequency response without increasing speaker enclosure size, though at the expense of cost and weight. In other words, two, identical, drivers are coupled to work together as one unit: the drivers are mounted one behind the other in an enclosure 24 which defines a sealed chamber of air in between them. A volume of this isobaric chamber is usually chosen to be small for reasons of convenience and to better couple the drivers 20, 22.

In a subwoofer loudspeaker, where a mid-range output is not needed, the optimum driver arrangement is front to front, i.e., an outer cone of one driver faces another outer cone of the other driver and the drivers are wired out of phase. In isobaric designs, the drivers are placed either cone to magnet and wired in phase with one another, or cone to cone or magnet to magnet and wired out of phase with one another so that their cones move together when driven with an audio signal. The term isobaric points to the somewhat erroneous notion that the air pressure in the sealed chamber between the drivers is constant (e.g., the isobaric condition), when in fact there will be small changes due to the differences in the drivers technical parameters and the air that each is pressurizing. One driver will be pressurizing the air in the listening room, while the other is pressurizing a smaller volume of air in the speaker enclosure.

The two drivers operating in tandem exhibit a similar behavior to that of one driver operating in twice the cabinet. The cabinet or loading chamber is defined as the air space behind the rear or loading driver. The volume of air between the speakers has no acoustic effect on the loading chamber space so that the saved space is less than fifty percent. Other aspects are unchanged like resonant frequency and maximum SPL. The new driver will have the same resonant frequency, Qts, excursion, etc. as one driver with the same applied signal. With optimal out of phase designs, distortion is slightly reduced due to the cancellation of suspension and other driver non-linearities. Because the impedance is also halved, the performance of an isobaric speaker is achieved with twice the power. The new efficiency is thus 3 dB lower than with one loudspeaker. The reason for the unchanged resonance frequency is simple: the new combined loudspeaker has twice the moving mass compared to the single driver but also half the compliance because of the doubled suspension.

The result is that the coupled driver pair (iso-group) can now produce the same frequency response in half the box volume that a single driver of the same type would require. For example, if a speaker is optimized for performance in a 40 liter enclosure, one iso-group of the same speakers can achieve the same low frequency extension and overall response characteristics in a 20 liter enclosure. The aforementioned volumes exclude the isobaric chamber. If the iso group is placed in the original 40 liter, the loading will be incorrect (if the 40 liter was a correct loading of the loudspeaker).

A critical review of isobaric loudspeakers reveals that isobaric loudspeakers are limited to the following: (1) bass applications only; (2) a single radiating driver radiating into a listening space and a single loading driver; and (3) the radiating and loading drivers must be identical. These limitations are very restrictive and significantly limit the possible solutions for reducing a loading chamber size. Accordingly, a more robust design is needed which operates across all frequency ranges, not just bass. In addition, many loudspeaker applications would benefit from having an array of radiating drivers to produce the sound volume and quality that is desired instead of just a single driver.

While multiple isobaric pairs could be utilized to provide the desired array in a reduced enclosure size, the reduction requires the addition of four drivers in a one-to-one ratio with the radiating drivers which significantly increases the cost and weight of the loudspeaker. Consider the required loading chamber volume for an array of four isobaric pairs 26, as shown in FIG. 4 for example, to illustrate the reduction in loading chamber volume, Vb, that isobaric offers. This example is solely for illustrative purposes as isobaric is somewhat rare for a single radiating driver and nearly non-existent for an array of radiating drivers. Even though this isobaric array configuration is rarely, if ever, adopted commercially, it is instructional to understand the effect isobaric has on the loading chamber volume and how the effect is calculated using conventional equations. Adding a line for the loading drivers to the radiating drivers described in Table 2 creates Table 3. Note that the loading drivers are identical to the radiating drivers, which is the isobaric practice.

TABLE 3

| Isobaric Driver Array Specification | Sd Area of Cone | Fs Resonant Frequency | Mms Air Mass Equivalent | Qts Resonant Peak |
|---|---|---|---|---|
| (4) 10" Radiating | 358 cm | 37.7 Hz | 53 g | 0.26 |
| (4) 10" Loading | 358 cm | 37.7 Hz | 53 g | 0.26 |

According to conventional isobaric loading chamber volume calculations, the Mms of the system is the combined Mms of the radiating and loading drivers. Further, the Sd, Fs, and Qts of the system are the same as for a single driver as both the radiating and loading drivers are the same. It should be noted, however, that the conventional method of calculating Vb does not contemplate a case where the radiating and loading drives do not have the same, or nearly the same, parameter values as discussed further below.

Plugging the values for Sd, Fs, and 2*Mms for each driver pair into equation 2 yields a result of:

$$Vas=k*Sd^2/(2*Mms*Fs^2)=36*358^2/(2*53*37.70^2)=30.6 \text{ liters} \quad (2)$$

$$Vb=Vas/((Qtc/Qts)^2-1)=30.6/((0.65/0.26)^2-1)=5.2 \text{ liters} \quad (1)$$

In other words, a loading chamber volume for each isobaric pair in the array configuration shown in FIG. 4 is 5.2 liters; therefore, a total loading chamber volume for all four pairs is 20.6 liters. This is a meaningful reduction from 40.8 liters with four radiating drivers and zero loading drivers; however, the desired space reduction of 20 liters is offset by the cost and weight of the four additional drivers. For these reasons, isobaric is rarely, if ever, used in driver arrays.

Accordingly, a need exists in the loudspeaker industry for an audio loudspeaker having a reduced loading chamber size for an array of drivers capable of producing high quality sound over a wide listening frequency range and without the costs of an additional loading driver for each radiating driver.

SUMMARY OF THE INVENTION

In accordance with the purposes and benefits described herein, an audio speaker is provided. The audio speaker may be broadly described as comprising an enclosure including a coupling chamber and a loading chamber, at least m radiating drivers and at least one and no more than m−1 loading driver(s), wherein m is at least two.

In another possible embodiment, the coupling chamber acts to couple a non-radiating face of the at least m radiating drivers and a face of the at least one and no more than m−1 loading driver(s).

In yet another possible embodiment, the loading chamber acts to load a face of the at least one and no more than m−1 loading driver(s).

In still another possible embodiment, each of the at least m radiating drivers radiate into a listening space.

In one other possible embodiment, at least one of the at least one and no more than m−1 loading driver(s) communicates with the loading chamber.

In yet still another possible embodiment, a volume of the loading chamber is substantially the same as a volume of the at least one and no more than m−1 loading driver(s).

In another possible embodiment, at least one of the at least one and no more than m−1 loading driver(s) is positioned at least partially within the loading chamber.

In yet another possible embodiment, the at least one of the at least one and no more than m−1 loading driver(s) is larger in size than the at least m radiating drivers.

In still another possible embodiment, the loading chamber includes a port and the at least one and no more than m−1 loading driver(s) is positioned at least partially within the loading chamber.

In one other possible embodiment, the loading chamber includes a port and the at least one and no more than m−1 loading driver(s) communicates with the coupling chamber.

In another possible embodiment, the loading chamber includes a drone cone and the at least one and no more than m−1 loading driver(s) is positioned at least partially within the loading chamber.

In still another possible embodiment, the loading chamber includes a drone cone and the at least one and no more than m−1 loading driver(s) communicates with the coupling chamber.

In one additional possible embodiment, the at least one and no more than m−1 loading driver(s) have a higher sensitivity than each of the at least m radiating drivers.

In one other possible embodiment, the at least m radiating drivers are arranged within the enclosure to minimize a volume of the coupling chamber.

In accordance with another possible embodiment, an audio speaker includes an enclosure including a coupling chamber and a loading chamber, first and second radiating drivers, and a loading driver having a diameter at least as large as a diameter of either of the first and second radiating drivers and a sensitivity at least as high as a sensitivity of either of the first and second radiating drivers.

In another possible embodiment, the coupling chamber acts to couple a non-radiating face of the first and second radiating drivers and the loading driver.

In yet another possible embodiment, the loading chamber acts to load a face of the loading driver.

In still another possible embodiment, the first and second radiating drivers radiate into a listening space.

In one other possible embodiment, the loading driver communicates with the loading chamber.

In yet still another possible embodiment, a volume of the loading chamber is substantially the same as a volume of the loading driver.

In another possible embodiment, the loading driver is positioned at least partially within the loading chamber.

In still another possible embodiment, the loading driver is larger in size than either of the first and second radiating drivers.

In another possible embodiment, the loading chamber includes one of a port or a drone cone.

In yet another possible embodiment, the loading driver has a higher sensitivity than either of the first and second radiating drivers.

In accordance with another possible embodiment, an audio speaker includes first and second drivers supported by an enclosure, the first and second drivers radiating outside of the enclosure and a sonic inducer supported by the enclosure between the coupling and loading chambers.

In another possible embodiment, the sonic inducer includes at least one of a third driver, a drone cone, and a port.

In yet another possible embodiment, the sonic inducer is an undriven third driver having first and second terminals, and further including a passive electrical load electrically connected across the first and second terminals of the undriven third driver.

In still another possible embodiment, the audio speaker includes a second sonic inducer supported by the enclosure between the loading chamber and ambient.

In another possible embodiment, the second sonic inducer includes at least one of a drone cone and a port.

In yet one other possible embodiment, the sonic inducer is an undriven third driver.

In the following description, there are shown and described several embodiments of audio speakers. As it should be realized, the audio speakers are capable of other, different embodiments and their several details are capable of modification in various, obvious aspects all without departing from the audio speakers as set forth and described in the following claims. Accordingly, the drawings and descriptions should be regarded as illustrative in nature and not as restrictive.

BRIEF DESCRIPTION OF THE DRAWING FIGURES

The accompanying drawing figures incorporated herein and forming a part of the specification, illustrate several aspects of the audio speakers and together with the description serve to explain certain principles thereof. In the drawing figures.

Reference will now be made in detail to the present embodiments of the audio speakers, examples of which are illustrated in the accompanying drawing figures, wherein like numerals are used to represent like elements.

DETAILED DESCRIPTION

Figure 5:
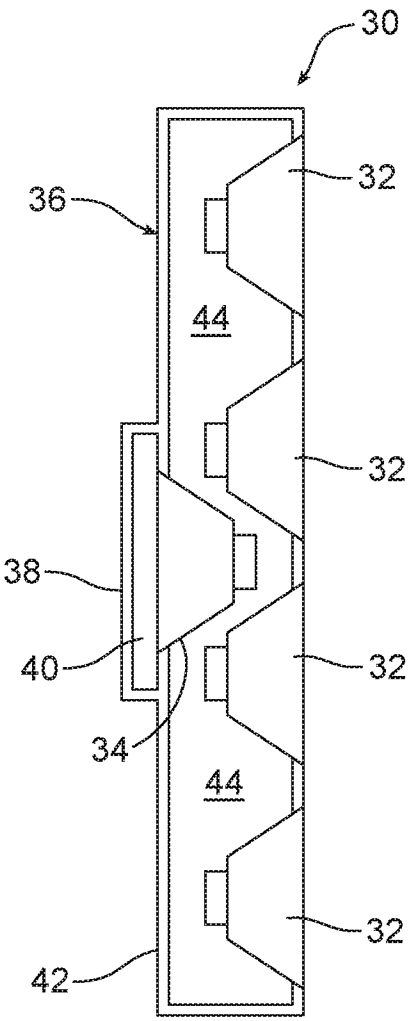
FIG. 5 is a section plan view of an audio speaker embodiment having four radiating drivers and a loading driver symmetrically positioned and generally within a coupling chamber with the loading driver communicating with a loading chamber.

Reference is now made to FIG. 5 which illustrates one embodiment of an audio speaker 30. As shown, the described audio speaker, or speaker, 30 includes four radiating drivers 32 and a loading electroacoustic transducer 34. In the described embodiment, the loading electroacoustic transducer 34 is a loading driver and the radiating drivers and loading driver all operate in common acoustic phase and are positioned generally within an enclosure 36. More specifically, the radiating drivers 32 and the loading driver 34 are attached to or supported by the enclosure 36 in a manner known in the art. For example, the drivers may be attached to a basket which similarly supports a spider and a cone or diaphragm in a known manner. The basket may include apertures through which fasteners extend to secure the basket to the enclosure. Of course, other known means of attaching or supporting drivers in a speaker may be utilized.

As shown, the enclosure 36 includes a loading portion 38 that defines a loading chamber 40 and a coupling portion 42 that defines a coupling chamber 44. The size and shape of the loading and coupling portions 38 and 42 and the defined loading and coupling chambers 40 and 44 may vary in size and/or shape based on design preference, desired output parameters, etc. In the described embodiment, the four radiating drivers 32 are supported by the enclosure 36 generally within the coupling chamber 44 such that the drivers radiate away from the enclosure into a listening space such as a room, stadium, venue, etc. In other words, the radiating drivers 32 create sound waves into the listening space. Similarly, the loading driver 34 is supported by the enclosure generally within the coupling chamber 44 but the driver communicates with the loading chamber 40 and the coupling chamber 44. In this arrangement, the radiating drivers 32 are loaded by the loading driver 34, and the loading driver is loaded by the loading chamber 40.

Figure 6:
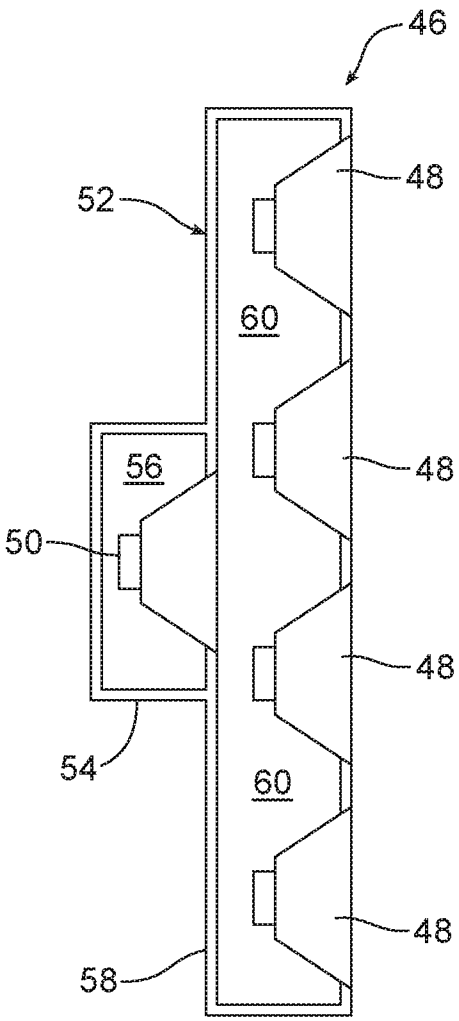
FIG. 6 is a section plan view of an audio speaker embodiment having four radiating drivers positioned generally within a coupling chamber with a loading driver positioned generally within a coupling chamber communicating with a loading chamber.

Turning to the embodiment shown in FIG. 6, the described speaker 46 similarly includes four radiating drivers 48 and a loading driver 50 all operating in common acoustic phase and positioned generally within an enclosure 52. As shown, the enclosure 52 includes a loading portion 54 that defines a loading chamber 56 and a coupling portion 58 that defines a coupling chamber 60. In the described embodiment, the four radiating drivers 48 are supported by the enclosure 46 generally within the coupling chamber 60 such that the drivers radiate away from the enclosure into a listening space. The loading driver 50, on the other hand, is supported by the enclosure 46 at least partially within the loading chamber 56 and communicates with the loading chamber 60.

Figure 4:
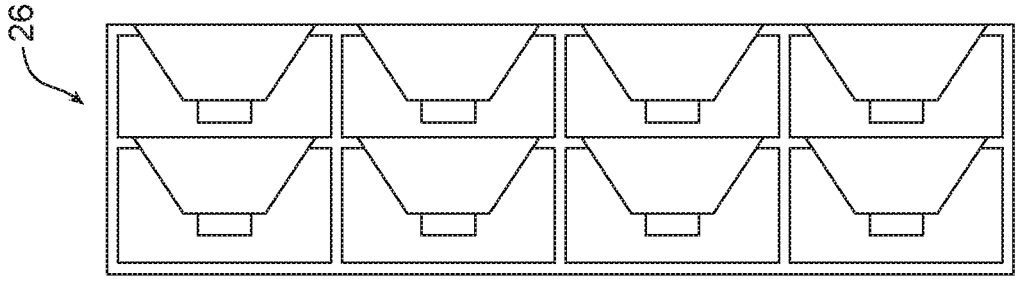
FIG. 4 PRIOR ART
FIG. 4 is a section plan view of an exemplary isobaric audio speaker showing an array of radiating drivers each having its own identical loading driver.
Figure 2:
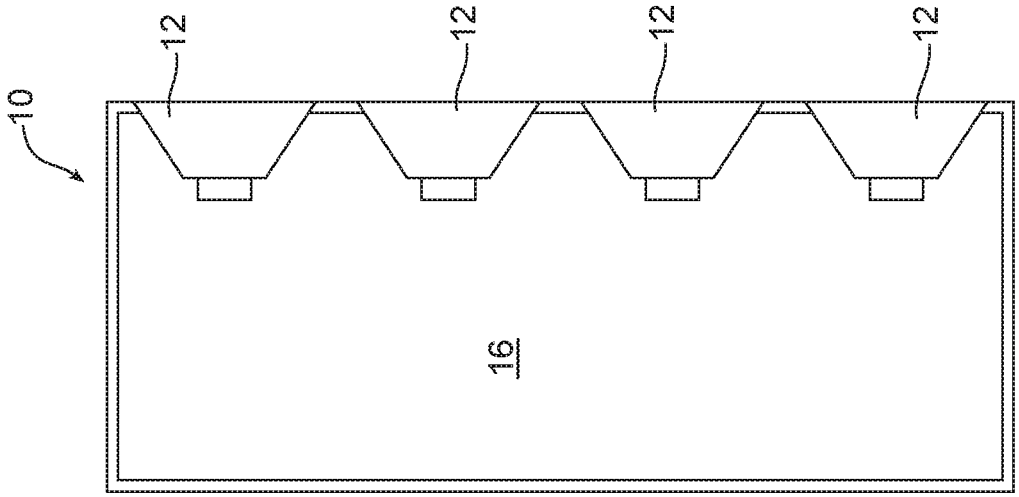
FIG. 2 PRIOR ART
FIG. 2 is a section plan view of a prior art audio speaker showing an array of radiating drivers sharing a common loading chamber.
Figure 1:
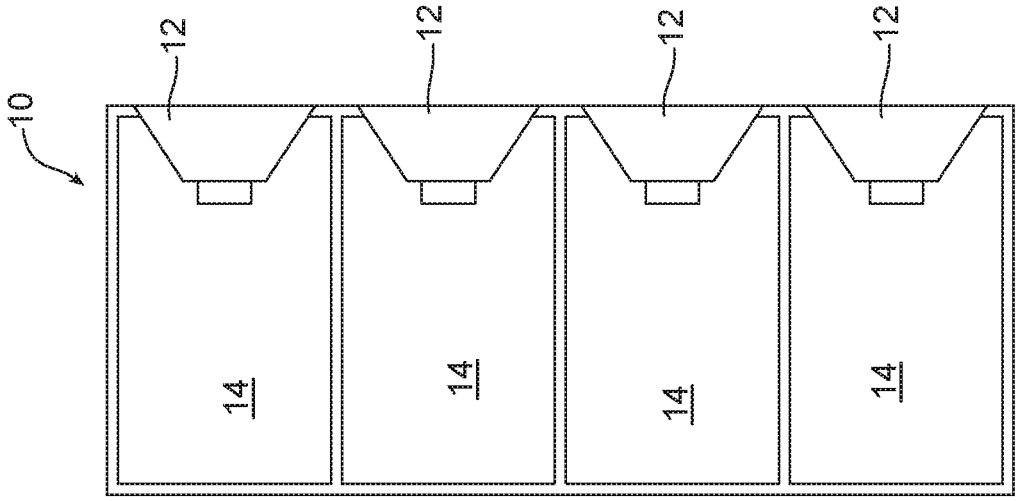
FIG. 1 PRIOR ART
FIG. 1 is a section plan view of a prior art audio speaker showing an array of radiating drivers each having its own loading chamber.
Figure 3:
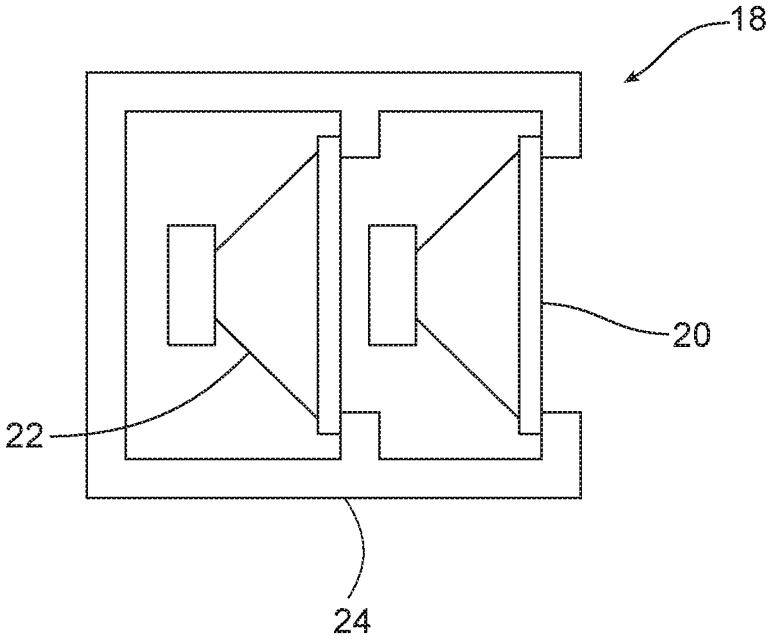
FIG. 3 PRIOR ART
FIG. 3 is a section plan view of a prior art isobaric audio speaker showing identical radiating and loading drivers.
Figure 7:
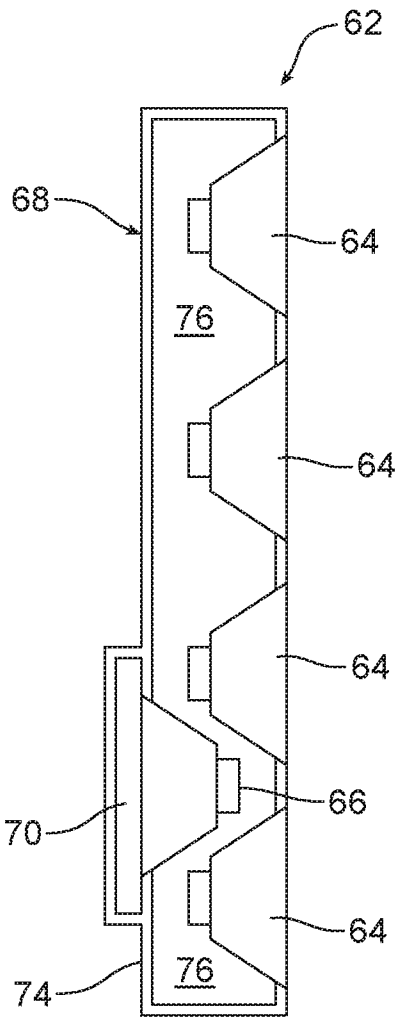
FIG. 7 is a section plan view of an audio speaker embodiment having four radiating drivers and a loading driver positioned generally within a coupling chamber with the loading driver communicating with the loading chamber.

As shown in FIG. 7, another embodiment includes a speaker 62 that similarly includes four radiating drivers 64 and a loading driver 66 all operating in common acoustic phase and positioned generally within an enclosure 68. As shown, the enclosure 68 includes a loading portion 70 that defines a loading chamber 72 and a coupling portion 74 that defines a coupling chamber 76. In the described embodiment, the four radiating drivers 64 are supported by the enclosure 68 generally within the coupling chamber 76 such that the drivers radiate away from the enclosure into a listening space. The loading driver 66 is similarly supported by the enclosure 68 generally within the coupling chamber 76 and communicates with the loading chamber 70 similar to the embodiment shown in FIG. 5. In this instance, the loading portion 70 and loading chamber 72 are offset in an asymmetrical manner. This results in the loading driver 66 being positioned generally between a lower two radiating drivers 64, as shown in FIG. 7, as opposed to the loading portion 38 and loading chamber 40 being more symmetrically positioned between a middle two radiating drivers 32, as shown in FIG. 5.

Figure 8:
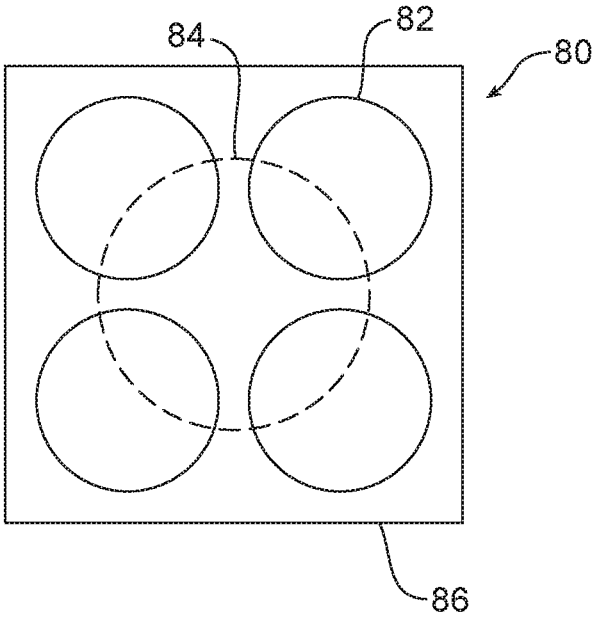
FIG. 8 is a front plan view of an audio speaker embodiment having four radiating drivers arranged within an enclosure to minimize a volume of a coupling chamber and a larger, centrally located loading driver.

Of course, a loading driver may be positioned at nearly any location within an enclosure so long as the loading driver is able to load the at least two radiating drivers. In one other embodiment shown in FIG. 8, a speaker 80 includes four radiating drivers 82 and a loading driver 84 (shown in dashed line) all operating in common acoustic phase. In this embodiment, the radiating drivers 82 are arranged within an enclosure 86 to minimize a volume of a coupling chamber. In this instance, the radiating drivers 82 generally form a square with the loading driver 84 centrally positioned therebetween. As shown, the loading driver 84 is larger in size than the radiating drivers 82. In this embodiment, the larger size includes a larger diameter. Although not shown in FIG. 8, the enclosure 86 includes a loading portion that defines a loading chamber and a coupling portion that defines a coupling chamber. The four radiating drivers 82 are supported by the enclosure 86 generally within the coupling chamber such that the drivers radiate away from the enclosure into a listening space. The loading driver 84 is also supported by the enclosure 86, generally within the coupling chamber, and communicates with the loading chamber similar to the embodiment shown in FIG. 5. Alternatively, the loading driver may likewise be supported within the loading chamber and may communicate with the coupling and/or loading chambers as described above in other embodiments.

The four key components of the above-described embodiments shown in FIGS. 5-8 include a radiating driver, a loading driver, a coupling chamber, and a loading chamber. A radiating driver generally includes a first or radiating face which creates sound waves radiating into a listening space for a listener to hear and a second or non-radiating face. A loading driver similarly includes first and second faces and acts to load the radiating drivers. As described above, the loading driver is used instead of a larger air space in the speaker enclosure to load the radiating drivers. A coupling chamber is defined by the speaker enclosure and includes an air space in which the loading driver is coupled with the non-radiating face of the radiating drivers in such a way as to encourage all radiating drivers and the loading driver(s) to move together in common acoustic phase. As described above, a first face of the loading driver communicates with a loading chamber and a second face communicates with a coupling chamber. Broadly speaking, the smaller the size of the coupling chamber the better, within limitations of how close the radiating drivers can be to each other and the loading driver based on the number of drivers, the geometry of the drivers, and how they are configured or arranged. Last, the loading chamber is also defined by the speaker enclosure and includes an air space in which the first or second face of the loading driver is loaded dependent upon the orientation of the loading driver. In its smallest form, a volume of the loading chamber is substantially the same as a volume of the loading driver(s). More specifically, the volume of the loading driver(s) refers to an air volume inside a concave shape of the loading driver cone/diaphragm.

In the described embodiments, the radiating drivers were chosen for their characteristics to produce sound at a desired level and quality over a desired frequency range. The loading drivers were selected to compliment the radiating drivers so that the loading chamber could be minimized and so that the radiating drivers would couple with the loading drivers in the coupling chamber. For illustration purposes, consider the radiating drivers in Table 2 and add a single loading driver to create Table 4 shown below. This configuration with these values was used in a test prototype which unexpectedly produced very satisfactory sound quality over a wide range of frequencies.

TABLE 4

| Prototype Drivers | Sd Area of Cone | Fs Resonant Frequency | Mms Air Mass Equivalent | Qts Resonant Peak |
|---|---|---|---|---|
| (4) 10" Radiating | 358 cm | 37.7 Hz | 53 g | 0.26 |
| (1) 15" Loading | 881 cm | 47 Hz | 106 g | 0.47 |

In order to use equations 1 and 2, set forth above, to determine a required loading chamber volume, Vb, guidance can be taken from the isobaric one-to-one methodology by combining the Mms for all 5 individual drivers to determine a composite Mms. This seems a reasonable place to start and free-air testing of the speaker system with added mass to the cones validates the method of adding the Mms of all drivers even when the loading driver is not identical to the radiating driver. Free-air testing of a single driver is well understood and involves stimulating the driver electrically without a loading chamber (hence free-air) and measuring the current response. A similar approach was adopted for free-air testing the described driver arrays whereby there was a coupling chamber between the radiating drivers and the loading driver(s), but there was not a loading chamber.

A second parameter to obtain for the described embodiment's illustrative driver array is the system Qts which is, fortunately, provided by the free-air test.

The third parameter to obtain for the described embodiment's illustrative driver array is the system Sd. This parameter is more troubling to obtain for the system since the total Sd for the radiating drivers is 4*358 cm=1,432 cm, which is considerably larger than the loading driver Sd of 881 cm. The one-to-one isobaric literature does not provide direction on what is the effective Sd of the system when the loading driver(s) is of different quantity and size relative to the radiating driver(s). Since the loading chamber interfaces directly with the loading driver(s) and not the radiating drivers, a reasonable place to start is to assume that the system Sd is the same as the loading driver Sd.

With the above assumptions the system parameters are estimated and shown in Table 5 below.

TABLE 5

| Prototype Drivers | Sd Area of Cone | Fs Resonant Frequency | Mms Air Mass Equivalent | Qts Resonant Peak |
|---|---|---|---|---|
| (4) 10" Radiating | 358 cm | 37.7 Hz | 53 g | 0.26 |
| (1) 15" Loading | 881 cm | 47 Hz | 106 g | 0.47 |
| System | 881 cm | 41 Hz | 318 g | 0.36 |

With this information, the anticipated loading chamber size, Vb, for the system can be calculated from equations 1 and 2, assuming that the equations are valid for the system with the loading driver(s) not identical to the radiating drivers:

$$Vas=k*Sd^2/(Mms*Fs^2)=36*881^2/(318*41^2)=52.3 \text{ liters} \quad (2)$$

$$Vb=Vas/((Qtc/Qts)^2-1)=52.3/((0.651.36)^2-1)=23.1 \text{ liters} \quad (1)$$

While a loading chamber size, Vb, of 23.1 liters in the test prototype represents a significant reduction and would be very satisfactory, actual testing of the prototype audio loudspeaker system revealed that a Vb of 5 liters is needed to yield an Qtc of 0.65. Five liters is essentially the air volume inside a concave shape of the loading driver cone, as the actual back wall of the loading chamber was flush with the driver after allowing for cone travel. In other words, it was impractical to make Vb smaller and the Vb volume did not take up any additional space outside the driver's cone. The actual Vb was an unanticipated ⅕ the volume of the anticipated Vb with the assumed parameter values from Table 5. As noted above, the volume of the loading driver refers herein to an air volume inside a concave shape of the loading driver cone/diaphragm.

It is interesting to note that the commonly practiced equations used to calculate loading chamber volume appear inadequate for a speaker system when the loading driver is not identical to the radiating driver. Most importantly, the result is a pleasantly surprising one—whereby the actual required loading chamber volume is very small. This result makes for a compelling case to reduce the loading chamber for an array of radiating drivers by adding a single loading driver. It should also be noted that multiple loading drivers of a smaller diameter could be deployed instead of the larger single. For example, two 12" drivers could have been used as the loading drivers in the described embodiments. But, one 15" driver will usually be less expensive than two 12" drivers, so a single loading driver will usually be chosen. The embodiments described herein were used as the subwoofer in several beta test live performances and the consistent feedback from listeners was that the bass sounded awesome. Interestingly, most listeners did not recognize the described embodiment as being the subwoofer since it was so small it did not fit into their paradigm of what a bass loudspeaker looked like.

A summary of the loading chamber volume for the various cases considered for implementing a four 10" radiating driver array with a Qtc of 0.65 for bass frequencies is shown in Table 6.

TABLE 6

| Configuration | Radiating Drivers | Qtc | Loading Drivers | FIG. | Vb (liters) |
|---|---|---|---|---|---|
| Conventional | 4 × 10" | 0.65 | None | 1 | 40.8 |
| Isobaric | 4 × 10" | 0.65 | 4 × 10" | 3 | 20.6 |
| One Embodiment | 4 × 10" | 0.65 | 1 × 15" | 5 | 5.0 |

A topic of relevance to the discussion of loading drivers not being identical to radiating drivers includes the conditions under which they couple. In this instance, coupling means that the drivers communicate with each other in such a way as to obtain a desired operating regime. The loudspeaker industry's conventional thought on the requirements for an isobaric pair of drivers coupling each other is that each driver in the pair is identical and are electrically manipulated from the amplifier so that they move forward and backward in unison, or are in common acoustic operation. Such a condition produces the assumed constant pressure in the coupling chamber and therefore facilitates coupling. Without coupling, the drivers would be acting independent of each other, or at least not having the desired effect on each other. The embodiments disclosed herein do not assume that the pressure is constant in the coupling chamber as does isobaric. Further, the embodiments disclosed herein assert that the loading driver can be different from the radiating drivers in size; however, for optimum results, coupling must occur between the loading driver(s) and the radiating drivers in order for the space reducing properties desired to be maximized while maintaining good sound quality.

Toward the objective of having a guideline for designing a coupled system where the loading driver(s) is different in size and quantity from the radiating drivers, the following is offered. Assuming the loading driver(s) is electrically manipulated at the same magnitude and in appropriate phase relative to the radiating drivers, then the loading driver(s) should have higher sensitivity than the radiating drivers. The parameter sensitivity is a measure of SPL produced for a given electrical input with the units of dB. So, a driver with a certain Sd and a higher sensitivity will displace more air volume than a driver of the same Sd but with lower sensitivity, assuming both are manipulated by the same electrical input.

The inventor has seen good results over a range of loading driver sensitivity relative to that of the radiating drivers in actual testing. Sizes available for both radiating and loading drivers are in steps such as 2", 3", 4", 6", 8", 10", 12" 15", 18", and 21" diameters. Therefore, a desired ratio of Sb radiating to Sb loading is not always possible to obtain precisely because a size needed to create the desired ratio may not exist. In general, an acceptable design (good sound quality with minimum size) may be reached with fewer design-build-test iterations by following this process assuming multiple radiating drivers with fewer loading drivers than radiating drivers: (1) determine a type and quantity of radiating drivers to accomplish sound reproduction objectives; (2) select or utilize a loading driver Sd equal to or larger than any single radiating driver; (3) select or utilize a loading driver(s) Sd (combined) equal to or smaller than all radiating drivers combined; (4) select or utilize a loading driver having an equal to or higher sensitivity than a radiating driver; (5) minimize the volume of the coupling chamber by geometric arrangement of the drivers; and (6) minimize the volume of the loading chamber. In using these steps, a first prototype should be configured with an aggressively small loading chamber that can be increased in size if necessary on subsequent prototype(s).

The parameters for steps (1) through (3) above are shown in Table 7.

TABLE 7

| Radiating Drivers | | | | Loading Drivers | | | |
|---|---|---|---|---|---|---|---|
| Qty × Dia | Sd each | Sd total | Sensitivity | Qty × Dia | Sd each | Sd | Sensitivity |
| 4 × 10" | 358 | 1432 | 91.6 | 1 × 15" | 881 | 881 | 96.0 |

It should be acknowledged that the mathematical modeling of speaker systems often is many years behind the practical implementation of an improvement. This will likely prove to be true for the disclosed invention in regards to both a) selecting loading and radiating drivers that will couple, and b) defining the mathematical equations that provide the required loading chamber volume for the selected drivers.

Many prototypes have been built and tested wherein the acoustic speaker includes m radiating drivers and at least one but less than m−1 loading driver(s) with satisfactory results. Examples are included in the following list, but the invention is in no way limited to these additional examples: (1) two radiating drivers with one loading driver; (2) three radiating drivers with one loading driver; (4) four radiating drivers with one loading driver, where the radiating drivers are arranged in one or two columns; (5) eight radiating drivers with one loading driver, where the radiating drivers are arranged in a single or multiple columns; (6) eight radiating drivers with two loading drivers, where the radiating drivers are arranged in a single or multiple columns; (7) bass frequency range only; and (8) full frequency range. For each example configuration listed above, many were successfully implemented with the loading driver being identical in size with the radiating drivers. However, superior results were generally obtained when the loading driver was larger in diameter than any one radiating driver and had a higher sensitivity.

Which configuration is chosen by the designer depends on certain preferences such as industrial design and considerations like minimizing the volumes of the coupling and loading chambers. The disclosed techniques provide for a very small loading chamber, and the coupling chamber is naturally more effective the smaller it is. So, the loudspeaker designer may choose how to configure the drivers so that overall loudspeaker size is minimized by minimizing distances between drivers in the direction(s) which are important in the application.

The foregoing has been presented for purposes of illustration and description. It is not intended to be exhaustive or to limit the embodiments to the precise form disclosed. Obvious modifications and variations are possible in light of the above teachings. For example, the described embodiments utilize one or more loading drivers but at least one less than a number of radiating drivers. In other embodiments, however, other sound pressure creation inducers, may be utilized. For example, the at least two radiating drivers may be combined with one or more sonic inducers such as an electroacoustic transducer (e.g., a loading driver) and a resonant exciter (e.g., an unpowered or undriven loading driver, a port, or a drone cone) as further described below.

Figure 9:
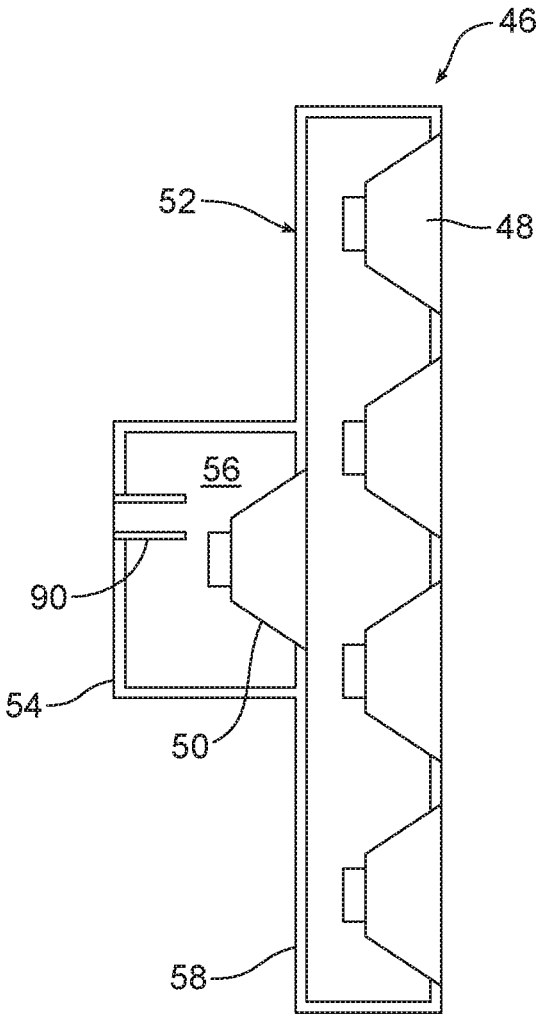
FIG. 9 is a section plan view of an audio speaker embodiment having four radiating drivers, a loading driver, and a ported loading chamber.
Figure 10:
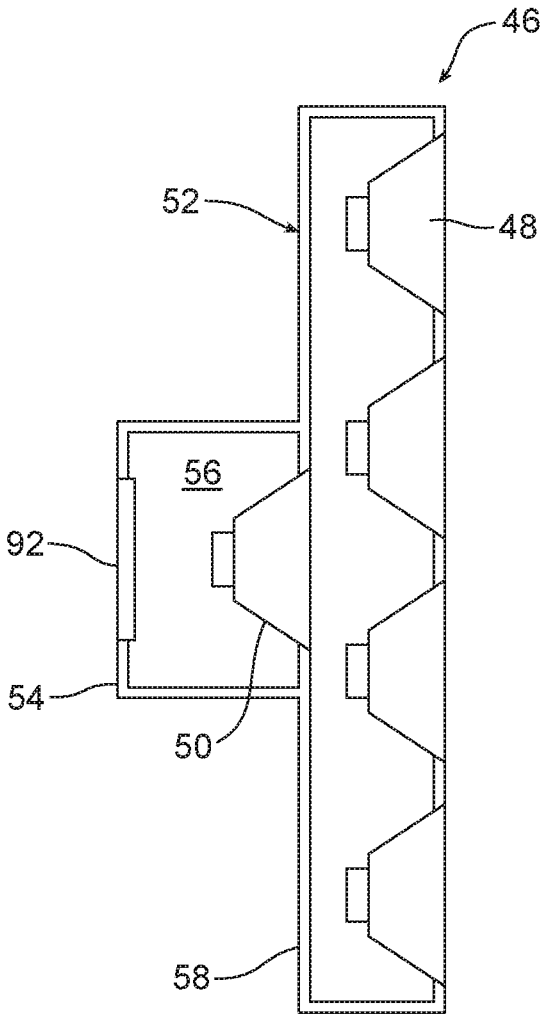
FIG. 10 is a section plan view of an audio speaker embodiment having four radiating drivers, a loading driver and a loading chamber drone cone.

As shown in FIGS. 9 and 10, a port 90 and a drone cone 92, respectively, may be added to the speaker 46 (shown in FIG. 6) which includes four radiating drivers 48 and a loading driver 50 all operating in common acoustic phase and positioned generally within an enclosure 52. The port 90 may be positioned along the loading portion 54 of the enclosure 52 that defines the loading chamber 56. Although shown on a rearward face of the loading portion 54, the port 90 could be positioned anywhere thereon with the port connecting or venting the loading chamber 56 to ambient air. Similarly, the drone cone 92 may be positioned along the loading portion 54 of the enclosure 52 that defines the loading chamber 56. Although the embodiment described in FIG. 6 is utilized to create the embodiments in FIGS. 9 and 10, a port and a drone cone, or both, may be utilized with any speaker design having at least m radiating drivers and at least one and no more than m−1 loading driver(s). In addition, the port and/or the drone cone may be replaced by a transmission line or horn as is known in the art in any of the noted embodiments.

Even more, each of the embodiments shown in FIGS. 5-10 may operate with one or more of the loading driver(s) not being powered or driven by an amplifier (not shown). Rather, the unpowered or undriven loading driver(s) may have a passive electrical load across its terminals made up of one or more components such as resistors, capacitors, and/or inductors. In such embodiments, the loading driver(s) power transfer works in reverse; instead of converting electrical power into acoustic power, the loading driver(s) take acoustic power from the back wave of the radiating drivers and converts the acoustic power to electrical power. The results of testing indicate similar benefits to those seen when the loading driver(s) are powered or driven by an amplifier.

Figure 11:
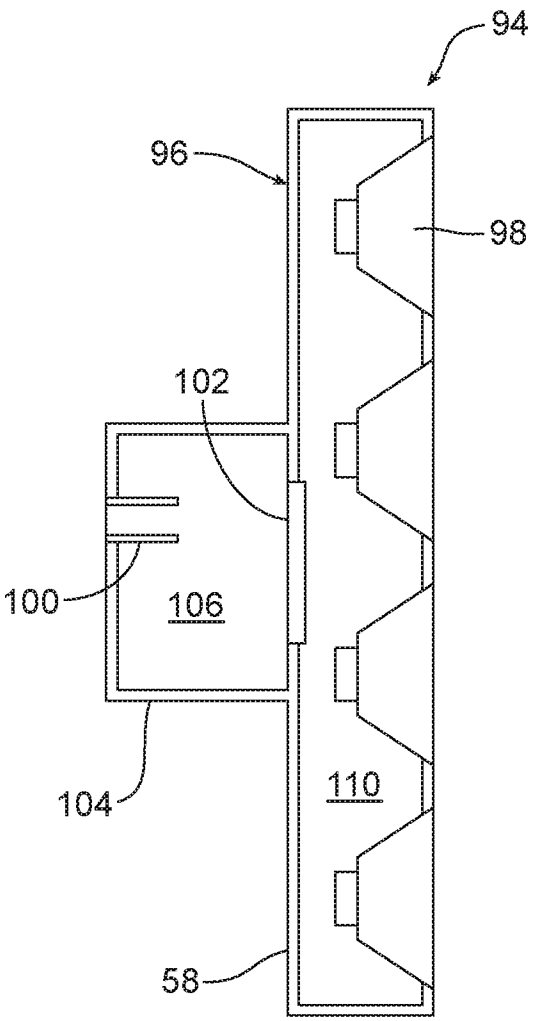
FIG. 11 is a section plan view of an audio speaker embodiment having four radiating drivers, a port supported by a loading portion of an enclosure and a drone cone supported by a coupling portion of the enclosure.
Figure 16:
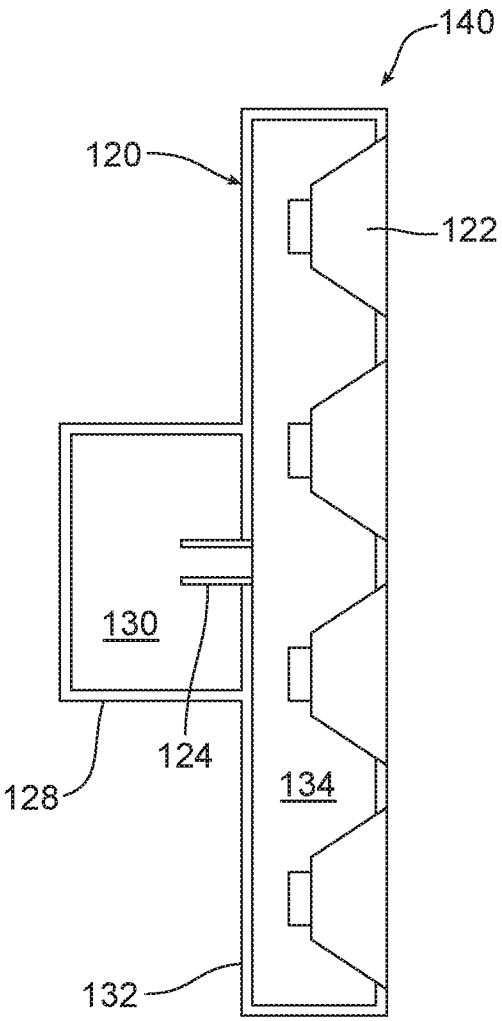
FIG. 16 is a section plan view of an audio speaker embodiment having four radiating drivers and a port supported by a coupling portion of an enclosure.

In even more embodiments, shown in FIGS. 11 and 16, one or more resonant devices (e.g., a combination of port(s) and drone cone(s)) may be added to a speaker which includes four radiating drivers positioned generally within an enclosure with no loading driver.

As shown in FIG. 11, a speaker 94 includes an enclosure 96, four radiating drivers 98, and two loading resonant devices. In the described embodiment, the loading resonant devices include a port 100 and a drone cone 102. More specifically, the radiating drivers 98, the port 100, and the drone cone 102 are attached to or supported by the enclosure 96 in a manner known in the art. As shown, the enclosure 96 includes a loading portion 104 that defines a loading chamber 106 and a coupling portion 108 that defines a coupling chamber 110. The size and shape of the loading and coupling portions 104 and 108 and the defined loading and coupling chambers 106 and 110 may vary in size and/or shape based on design preference, desired output parameters, etc. In the described embodiment, the four radiating drivers 98 are supported by the enclosure 96 generally within the coupling chamber 108 such that the drivers radiate away from the enclosure into a listening space such as a room, stadium, venue, etc. Similarly, the drone cone 102 is supported by the coupling portion of the enclosure 96 and the port 100 is supported by the loading portion of the enclosure and vents to ambient air.

Figure 13:
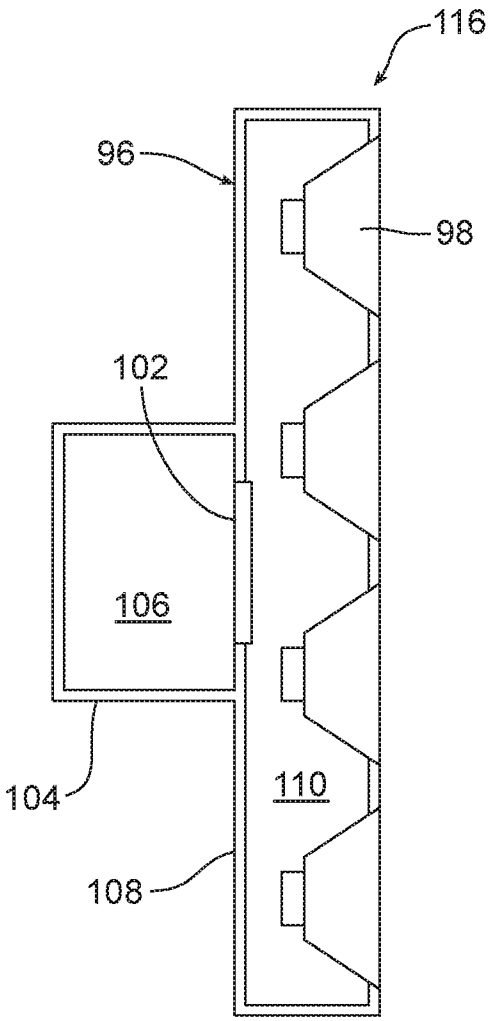
FIG. 13 is a section plan view of an audio speaker embodiment having four radiating drivers and a drone cone supported by a coupling portion of an enclosure.
Figure 12:
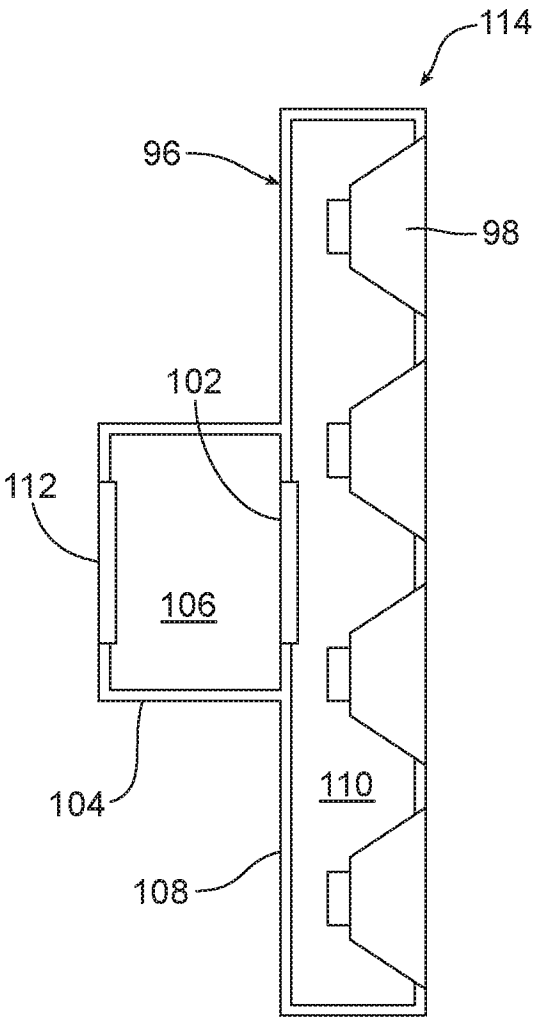
FIG. 12 is a section plan view of an audio speaker embodiment having four radiating drivers, and two drone cones with one supported by a loading portion and the other supported by a coupling portion of an enclosure.

In another embodiment shown in FIG. 12, the port 100 of the speaker 94 described in FIG. 11 can be replaced with a second drone cone 112 forming a different speaker 114. Similarly, the port 100 of the speaker 94 described in FIG. 11 may simply be removed forming another different speaker 116 as shown in FIG. 13. In addition, the port and/or the drone cone in each of the embodiments shown in FIGS. 11-13 may be replaced by a transmission line or horn as is known in the art.

Figure 14:
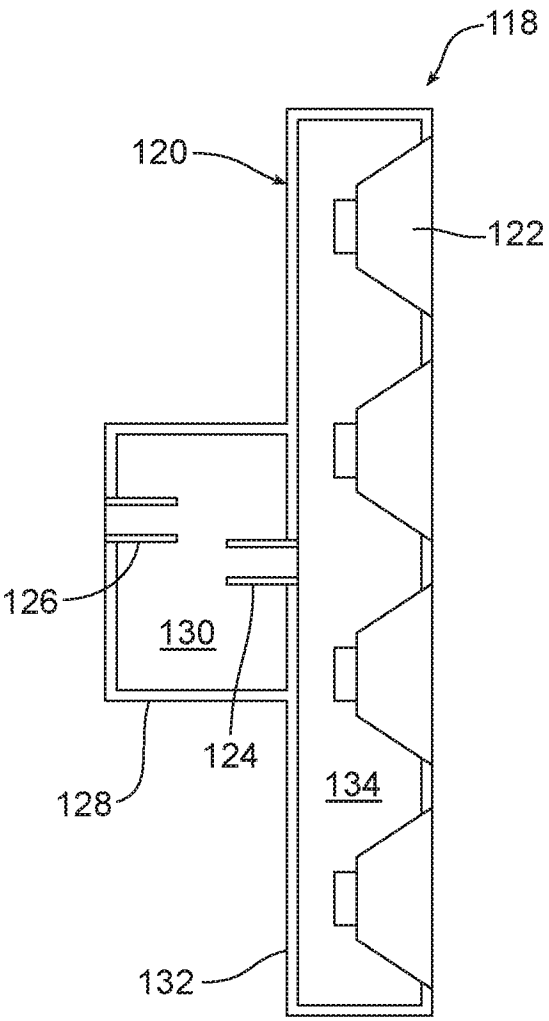
FIG. 14 is a section plan view of an audio speaker embodiment having four radiating drivers and two ports with one supported by a loading portion and the other supported by a coupling portion of an enclosure.

As shown in FIG. 14, a speaker 118 includes an enclosure 120, four radiating drivers 122, and first and second ports 124, 126. More specifically, the radiating drivers 122, the first port 124, and the second port 126 are attached to or supported by the enclosure 120 in a manner known in the art. As shown, the enclosure 120 includes a loading portion 128 that defines a loading chamber 130 and a coupling portion 132 that defines a coupling chamber 134. The size and shape of the loading and coupling portions 128 and 132 and the defined loading and coupling chambers 130 and 134 may vary in size and/or shape based on design preference, desired output parameters, etc. In the described embodiment, the four radiating drivers 122 are supported by the enclosure 120 generally within the coupling chamber 134 such that the drivers radiate away from the enclosure into a listening space such as a room, stadium, venue, etc. Similarly, the first port 124 is supported by the coupling portion of the enclosure 120 and vents into the loading chamber 130 and the second port 126 is supported by the loading portion of the enclosure and vents to ambient air.

Figure 15:
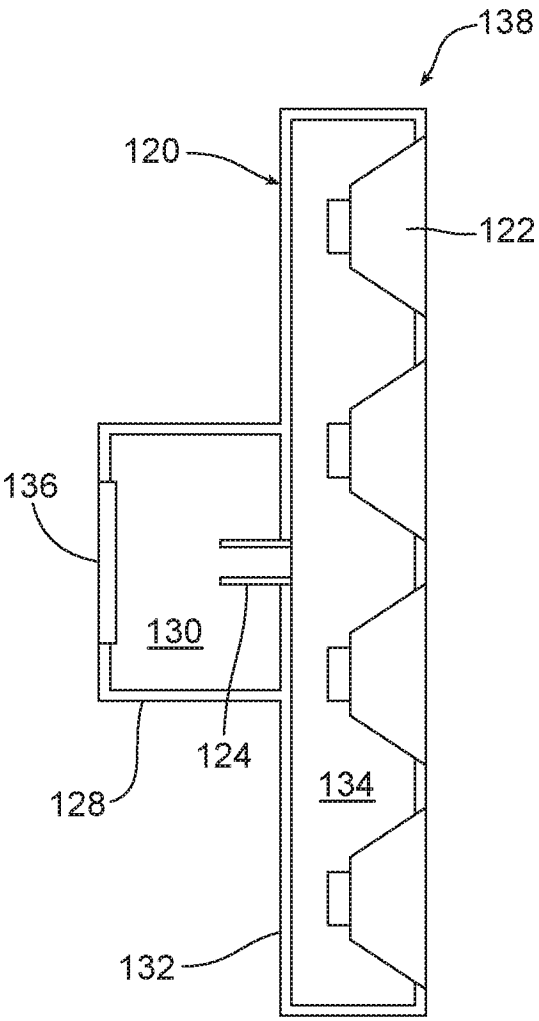
FIG. 15 is a section plan view of an audio speaker embodiment having four radiating drivers and a drone cone supported by a loading portion of an enclosure and a port supported by a coupling portion of the enclosure.

In another embodiment shown in FIG. 15, the second port 126 of the speaker 118 described in FIG. 14 can be replaced with a drone cone 136 forming a different speaker 138. Similarly, the second port 126 of the speaker 118 described in FIG. 14 may simply be removed forming another different speaker 140 shown in FIG. 16. In addition, the port and/or the drone cone in each of the embodiments shown in FIGS. 14-16 may be replaced by a transmission line or horn as is known in the art.

All such modifications and variations are within the scope of the appended claims when interpreted in accordance with the breadth to which they are fairly, legally and equitably entitled.

What is claimed:

1. An audio speaker, comprising:

an enclosure including a sealed coupling chamber;

at least m radiating drivers in communication with the coupling chamber; and at least one and no more than m−1 loading driver(s) in communication with the coupling chamber;

wherein m is at least two and all radiating drivers in communication with the coupling chamber operate in common acoustic phase.

2. The audio speaker of claim 1, wherein the coupling chamber acts to couple a non-radiating face of the at least m radiating drivers and a face of the at least one and no more than m−1 loading driver(s).

3. The audio speaker of claim 2, wherein a loading chamber acts to load a face of the at least one and no more than m−1 loading driver(s).

4. The audio speaker of claim 1, wherein all radiating drivers radiate into a listening space.

5. The audio speaker of claim 1, wherein at least one of the at least one and no more than m−1 loading driver(s) communicates with a loading chamber.

6. The audio speaker of claim 5, wherein the loading chamber includes a port and wherein the at least one and no more than m−1 loading driver(s) is positioned at least partially within the loading chamber.

7. The audio speaker of claim 5, wherein the loading chamber includes a port and wherein the at least one and no more than m−1 loading driver(s) communicates with the coupling chamber.

8. The audio speaker of claim 5, wherein the loading chamber includes a drone cone and wherein the at least one and no more than m−1 loading driver(s) is positioned at least partially within the loading chamber.

9. The audio speaker of claim 5, wherein the loading chamber includes a drone cone and wherein the at least one and no more than m−1 loading driver(s) communicates with the coupling chamber.

10. The audio speaker of claim 1, wherein a volume of a loading chamber is substantially the same as a volume of the at least one and no more than m−1 loading driver(s).

11. The audio speaker of claim 1, wherein at least one of the at least one and no more than m−1 loading driver(s) is positioned at least partially within a loading chamber.

12. The audio speaker of claim 1, wherein at least one of the at least one and no more than m−1 loading driver(s) is larger in size than the at least m radiating drivers.

13. The audio speaker of claim 1, wherein the at least one and no more than m−1 loading driver(s) having a higher sensitivity than each of the at least m radiating drivers.

14. The audio speaker of claim 1, wherein the at least m radiating drivers are arranged within the enclosure to minimize a volume of the coupling chamber.

15. The audio speaker of claim 1, wherein the at least one and no more than m−1 loading driver(s) has a diameter at least as large as a diameter of each of the at least m radiating drivers and a sensitivity at least as high as a sensitivity of each of the at least m radiating drivers.

16. The audio speaker of claim 15, wherein the coupling chamber acts to couple a non-radiating face of the at least m radiating drivers and the at least one and no more than m−1 loading driver(s).

17. The audio speaker of claim 16, wherein a loading chamber acts to load a face of the at least one and no more than m−1 loading driver(s).

18. The audio speaker of claim 15, wherein each of the at least m radiating drivers radiate into a listening space.

19. The audio speaker of claim 15, wherein at least one of the at least one and no more than m−1 loading driver(s) communicates with a loading chamber.

20. The audio speaker of claim 15, wherein a volume of a loading chamber is substantially the same as a volume of the at least one and no more than m−1 loading driver(s).

21. The audio speaker of claim 15, wherein the at least one and no more than m−1 loading driver(s) is positioned at least partially within a loading chamber.

22. The audio speaker of claim 15, wherein at least one of the at least one and no more than m−1 loading driver(s) is larger in size than the at least m radiating drivers.

23. The audio speaker of claim 15, wherein a loading chamber includes one of a port or a drone cone.

24. The audio speaker of claim 15, wherein a loading chamber includes a port and wherein at least one of the at least one and no more than m−1 loading driver(s) is positioned at least partially within the loading chamber.

25. The audio speaker of claim 15, wherein a loading chamber includes a port and wherein at least one of the at least one and no more than m−1 loading driver(s) communicates with the coupling chamber.

26. The audio speaker of claim 15, wherein a loading chamber includes a drone cone and wherein at least one of the at least one and no more than m−1 loading driver(s) is positioned at least partially within the loading chamber.

27. The audio speaker of claim 15, wherein a loading chamber includes a drone cone and wherein at least one of the at least one and no more than m−1 loading driver(s) communicates with the coupling chamber.

28. The audio speaker of claim 1, wherein all radiating drivers in communication with the coupling chamber are mounted and electrically connected so as to be in the same acoustic polarity.

* * * * *